United States Patent [19]

Whitley, II

[11] Patent Number: 4,712,501

[45] Date of Patent: Dec. 15, 1987

[54] BOAT VENT

[75] Inventor: Warwick M. Whitley, II, Panama City, Fla.

[73] Assignee: Attwood Corporation, Lowell, Mich.

[21] Appl. No.: 14,224

[22] Filed: Feb. 12, 1987

[51] Int. Cl.[4] ..... B63J 2/00

[52] U.S. Cl. ..... 114/211

[58] Field of Search ..... 114/177, 211; 98/121.1, 98/114; 29/160; 52/473; D23/110–115

[56] References Cited

U.S. PATENT DOCUMENTS

| | | | |
|---|---|---|---|
| 1,784,841 | 12/1930 | Landau . | |
| 2,639,012 | 5/1953 | Fitzgerald | 189/82 |
| 2,905,286 | 9/1959 | Adams et al. | 189/82 |
| 4,251,966 | 2/1981 | Foltmann | 52/309.1 |
| 4,453,762 | 6/1984 | Deaver | 296/97 A |
| 4,469,366 | 9/1984 | Deaver | 296/97 A |

FOREIGN PATENT DOCUMENTS 516979 1/1940 United Kingdom .

OTHER PUBLICATIONS

P. 78 from Assignee's Catalog.

U.S. appl. Ser. No. 730,959 filed 5/6/85 entitled Venturi Louvered Vent and assigned to the assignee of the present invention.

*Primary Examiner*—Sherman D. Basinger

*Assistant Examiner*—Jesûs D. Sotelo

*Attorney, Agent, or Firm*—Price, Heneveld, Cooper, DeWitt & Litton

[57] ABSTRACT

A grill to be mounted over a ventilation opening of a boat has a molded plastic primary section and separate indentical molded plastic end sections. Interengaging fingers automatically align the sections at installation. To accommodate vent openings of different lengths, only the primary section has to be changed.

14 Claims, 9 Drawing Figures

10
11
12
14
15
16
18
18a
20
21
22
23
24
25
30
A
VII

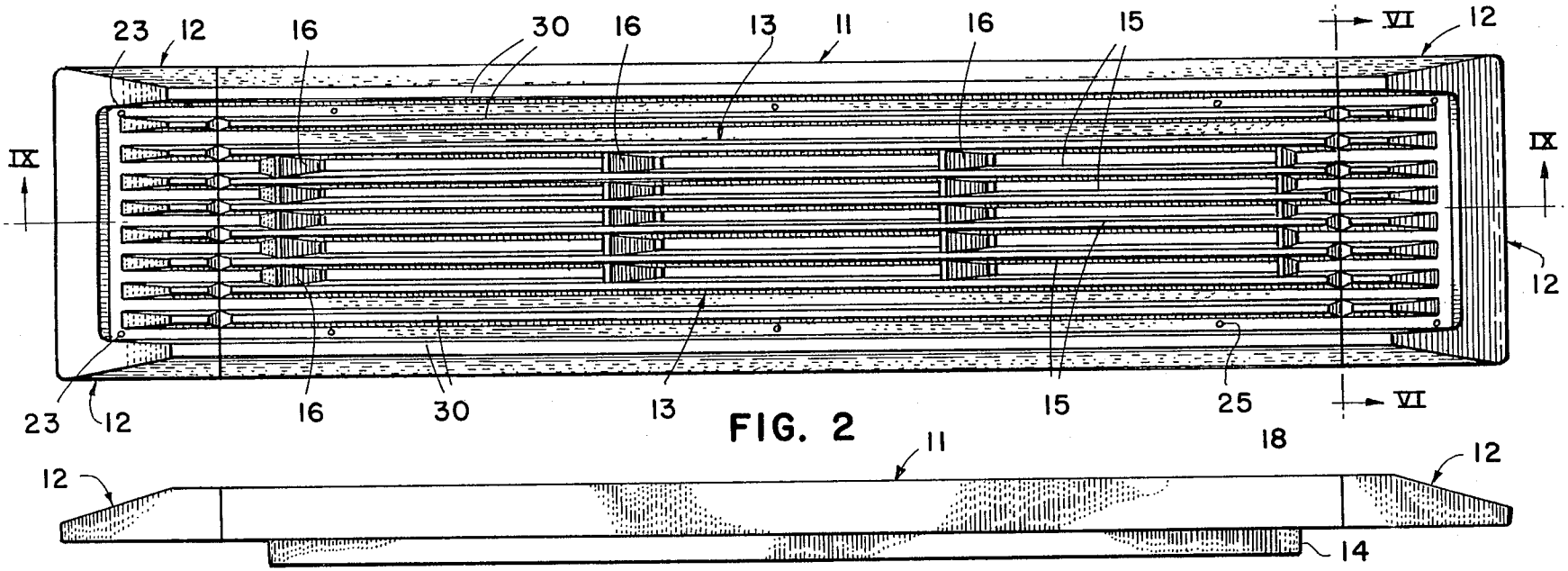
FIG. 2
FIG. 3
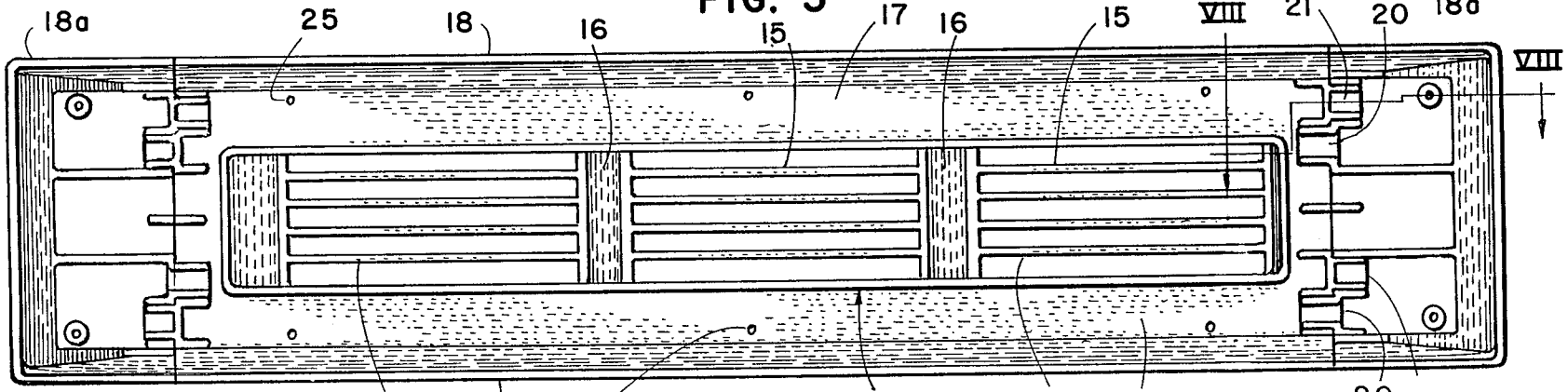
FIG. 4

BOAT VENT

FIELD OF THE INVENTION

This invention relates to ventilator grills of the type suitable for mounting over the air ventilator openings for engine compartments of marine craft, both for the purpose of ornamentation but also for the purpose of exclusion of water. While this is its primary use, it will be recognized that it could be used for other purposes, including cabin ventilation or for non-marine use.

BACKGROUND OF THE INVENTION

From both a cost and a maintenance point of view, it has become increasingly desirable to mold complicated configurations, such as ventilator grills from plastic rather than assembling them from metal stampings. Also, this arrangement has aesthetic advantages. However, the use of molded plastic for this type of product has been considered disadvantageous from the point of view of cost. The size of the openings to which ventilators of this type are applied varies substantially from one boat design to another. In part, this is due to differences in air flow requirements of various size engines and differences in the design of the engine compartment itself. Also, in some cases, aesthetics are in influencing factor on the size of the grill. In the case of metal grills, while this problem was a nuisance, it was not a substantial cost factor because these grills were either assembled for a number of separate components or the dies from which they were stamped were less expensive than molds for a plastic product of comparable size. With molded plastic grills, because each size of grill has required a separate mold, good only for making that particular grill size the investment in tooling has been very high. Since these grills are of substantial size, the cost of the molds was, for all practical purposes, prohibitive, unless there was a particular size with a large volume demand. The invention has as a primary objective a grill construction which materially reduces mold costs without sacrifice of the grills' ornamental and functional characteristics. The invention also makes it possible to satisfy the requirements of ventilator openings of a variety of sizes, all having the same basic ornamental exterior appearance.

BRIEF DESCRIPTION OF THE INVENTION

The invention provides a grill having a primary central portion and a pair of identical end portions. To accommodate grill openings of various sizes, it is only necessary to mold different central or primary portions to which end portions of a single design and construction can be assembled at the point of use. A single mold provides both ends for all sizes. This materially reduces mold costs and complexity and also substantially reduces the inventory requirements of the both the manufacturer and of the user of these grills. Also, for any given grill, the size of the mold is reduced. This contributes to molding cost reduction by requiring small capacity machines and may reduce cycling time. The invention also provides an interlock between the central portion and the end portions which both positively aligns them and also significantly simplifies the installation. The invention accomplishes this without sacrifice of either aesthetics or functionality.

BRIEF DESCRIPTION OF THE DRAWINGS

FIG. 2 is a top plan view of ventilator illustratedd in FIG. 1;

FIG. 3 is a side elevation view of the ventilator;

FIG. 4 is a bottom view of the ventilator;

DESCRIPTION OF THE PREFERRED EMBODIMENT

Figures 1, 5, 6, 7, 8, 9:
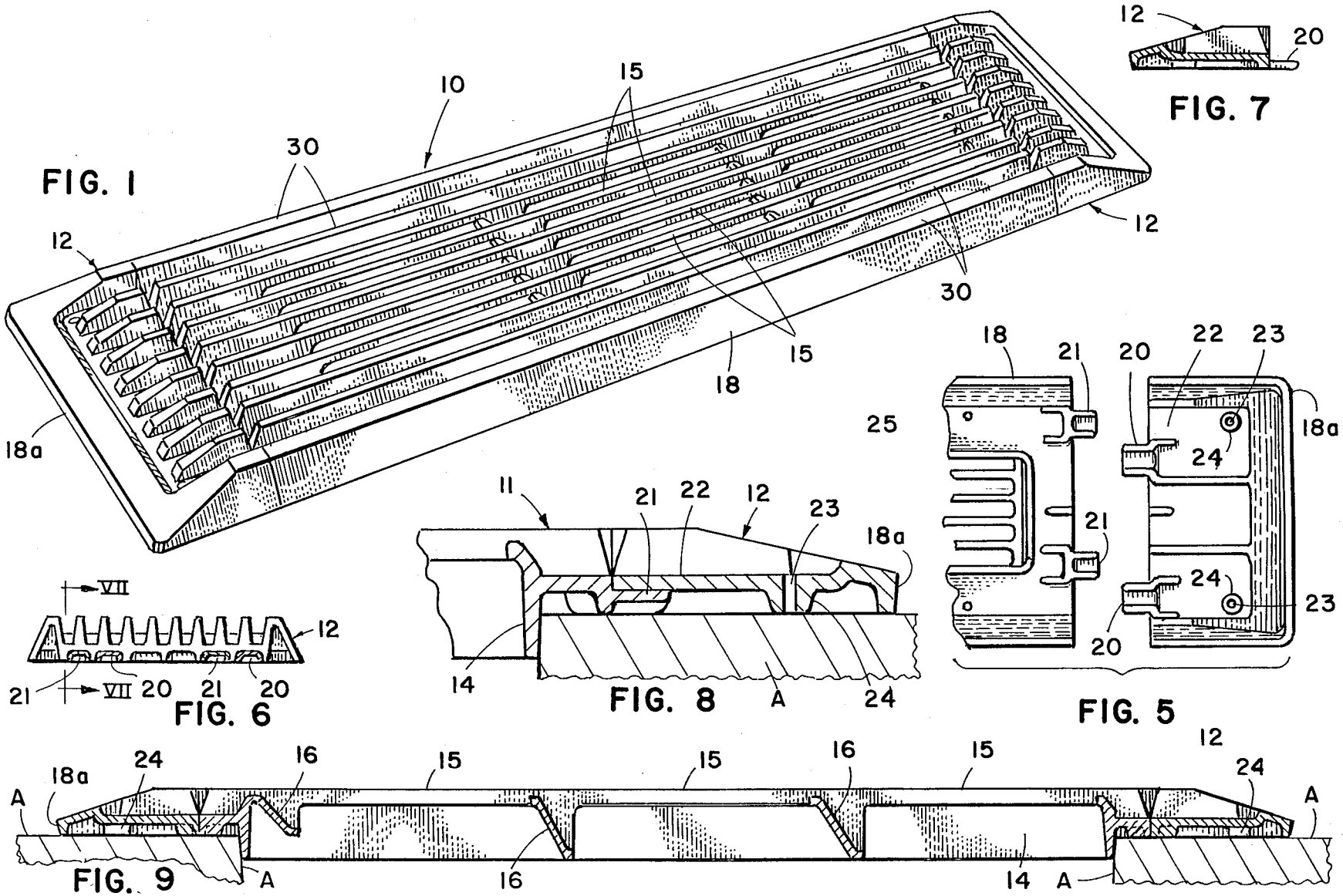
FIG. 1 is an oblique top view of a ventilator incorporating this invention.
FIG. 5 is a fragmentary, exploded, bottom view of a typical end of the ventilator.
FIG. 6 is an elevation view of the inner end of one of the end sections of the ventilator.
FIG. 7 is a sectional, elevation view taken along the plane VII—VII of FIG. 6.
FIG. 8 is an enlarged, fragmentary, sectional view taken along the plane VIII—VIII of FIG. 4.
FIG. 9 is a sectional, elevation view taken along the plane IX—IX of FIG. 2.

Referring to FIG. 1, numeral 10 indicates a ventilator having a central or primary section 11 and a pair of end sections 12. As best seen FIG. 4, the primary section has a central zone or opening 13 surrounded by a peripheral flange 14. Within the opening, are a plurality of elongated, bar-like vanes 15 integral at each end of the opening 13 with the body of the primary section. At equally spaced intervals between the ends of the opening 13 the vanes are connected and stabilized by inclined louvers 16. Preferably, these are inclined in the longitudinal direction of the grill for the purpose of water exclusion. Since the assembled grill is symmetrical about both its longitudinal and lateral centerlines, the grill can be positioned to properly orient the louvers.

The body of the primary section 11 is wider than the opening 13 and, thus, one each side is flanked by a skirt portion 17 of substantial width. The skirt portions 17 extend the full length of the primary section and along their outer edges have rearwardly extending edge portions which form a peripheral rim 18. As is best seen FIG. 3, the rim 18 provides a support for the grill which will seat against the surface of a boat panel on each side of a ventilation opening. It will also be noted from FIG. 3 that the flange 14 extends inwardly further than the rim 18 and is specifically designed to extend into the ventilation opening in the boat panel and, thereby, it locates the ventilator with respect to that opening. Between the rim 18 and the flange 14 the back or inner face of the skirt portion 17 is recessed. This is also true of the portions beyond the end of the opening 13 and the flange 14.

The end sections 13 are identical, each having a rim **18*a* along each side and along the end opposite from the primary section. Like the primary section, the inner face of the ends is recessed to the same depth as the skirt 17. Both the end sections and the primary section have fingers which are designed to interengage and, thereby, locate the end sections with respect to the central section both longitudinally and laterally. As is best seen in FIG. 5, each end section has a pair of fingers 20 integral with the web 22 which extend down into the recess on the inner side of the ends and have their inner faces in the same plane as the inner edge of the rim 18*a*. These fingers are illustrated as being of generally U-shaped cross section (FIG. 6). The lateral width of the fingers is reduced at the base of the projection of the finger from the end of the edge of the panel or web 22 which abuts the central member (FIG. 5). The fingers 20** are spaced apart a substantial portion of the width of the end sections and are offset to one side of the longitudinal center line of the ventilator (FIG. 5).

The fingers 21 which project from both ends of the primary section are identical to the fingers 20, having the same size, the same lateral spacing and the same amount of lateral offset as the fingers 20. However, in the case of the fingers 21 on the primary section, the offset is to one side on one end and to the opposite side on the other end. This permits an end section of a single design to be used on either end of the ventilator. It will be noted from FIG. 8 that the fingers 21 of the primary section extend under or inside the web 22 of the end sections. Thus, the fingers 21 are trapped between the surface of the boat panel A on which the ventilator is mounted and the panel or web 22 of the end section. Thus, when the end sections are secured to the boat panel by fasteners inserted through the openings 23, the primary section will be positively locked against separation from the panel to which the ventilator is mounted. The sliding interfit of the fingers provides the positive alignment necessary to preserve the ornamental appearance of the assembled grill. It also prevents misalignment because an end member might be biased to twist during installation. So that the fasteners inserted through the openings 23 can be firmly tightened, the openings 23 are surrounded by support bosses 24, as best seen in FIGS. 5 and 9. Additional attachment of the primary section may be effected by fasteners installed through the openings 25 in the primary section. Whether these are necessary will depend upon the size of the panel.

It will be noted from FIG. 2 that in addition to the vanes 15, the ventilator, as shown in the preferred form on the drawings also has rib-like projections 30 on each side of the ribs 15 overlying the openings. The rib-like projections or ribs 30 on the outer face overlay the recessed portions of the skirts 17 and serve both as ornamentation and as stiffeners for the primary section. It will be recognized that the central opening 13 of the ventilator could be enlarged by widening the opening and extending the flange 14 so that it is beneath one of the ribs 30 rather than one of the ribs 15. Thereby, without lengthening the ventilator, the total air flow capacity of the ventilator could be increased.

The primary section 11 and each of the end sections 12 are molded as single integral components from a suitable plastic material. Inasmuch as ventilators of this type used for marine purposes are normally exposed to sunlight and other environmental conditions which tend to deteriorate plastics, a particularly suitable material from which these components can be molded is a polyvinylcholoride (PVC) or it can be an acrylonitrile butadiene stryene also known as an ABS. These plastics have good ultraviolet resistance.

The invention, in addition to providing a design which is particularly suitable to produce an ornamentally desirable and finished appearance, has the advantage of reducing manufacturing and inventory costs. By separating the end sections from the primary section, the size and complexity of the mold necessary for the primary member is reduced. This reduces mold costs and may in some cases significantly affect operating costs by reducing the size of the equipment required and reducing cycling time. It also makes possible molding of all end section requirements using a mold of a single design. The mold is smaller, less complex and, thus, less costly. Also, its initial and maintenance costs are spread over a greater volume of product.

Inventory costs are reduced for both manufacturer and user. The user needs to inventory only those particular primary section sizes he uses while maintaining an inventory of universally useful end sections. If design changes make it necessary to change grill size, only the primary portion needs to be changed since the ends are universal to all sizes. Because the fingers 20 and 22 interengage as the ends are assembled to the primary section, the ends automatically align with the primary member as the ventilator is assembled and installed on the boat. No special tools or training are necessary. This saves time and prevents errors.

Having described a preferred embodiment of the invention, it will be understood that other embodiments can be made without departing from the principles of the invention. Such modifications are to be considered as included in the hereinafter appended claims unless these claims by their language expressly state otherwise.

I claim:

1. A grill for covering a vent opening in a panel of a boat, said grill having a primary section and a pair of end sections, said primary section having a ventilation zone, said zone having a plurality of air flow openings extending therethrough, said zone being spaced from both sides and the ends of said primary section; each of said end sections and ends of said primary section having a back face with a recess therein, said primary and end sections having abutting edges and interengaging fingers in their respective recesses and projecting from their respective edges with the fingers on said primary section extending into the recess and behind the back face of the corresponding one of said end sections whereby said end sections hold said primary section against the surface of said panel.

2. A grill as described in claim 1 wherein said fingers on both said primary and end sections are arranged in pairs.

3. A grill for a boat as described in claim 2 wherein said fingers having interengaging lateral surfaces which slidably seat against each other as the end sections are assembled to the primary section for accurately aligning the end sections with the primary section.

4. A grill for a boat as described in claim 3 wherein said lateral surfaces of said fingers have interengaging lateral offsets for further stabilizing the position of said end sections with respect to said primary section.

5. A grill as described in claim 3 wherein said pairs of fingers on said end sections are offset laterally from the longitudinal centerline of said grill in the same direction and the pairs of fingers of said primary section are offset from said longitudinal centerlines of said grill in opposite directions at opposite ends of said primary section whereby end sections of identical design can be used at both ends of said primary section.

6. A grill for a boat as described in claim 2 wherein said end sections are identical and the fingers are offset laterally from the center line of the grill and the fingers of said primary section are laterally offset in opposite directions at the opposite ends of the primary section whereby the same end can be secured to either end of the primary section.

7. A grill for a boat as described in claim 6 wherein said primary and end sections are each molded from synthetic resin as a single integral component.

8. A grill for a boat as described in claim 7 wherein said primary section is characterized by an exterior surface formed by a plurality of elongated parallel spaced vanes extending lengthwise of said zone and having narrow elongated recesses between them.

9. A grill for a boat as described in claim 8 wherein each of said end sections has vane-like members aligned with said vanes of said primary sections; and openings for fastener means to anchor the grill to the boat panel, said openings being located in the respective said recess.

10. A grill for a boat as described in claim 1 wherein said primary section has a skirt extending laterally from each side thereof, said skirts having a rearwardly extending rim forming the outer edge thereof for seating against the surface of the panel.

11. A grill as described in claim 1 wherein said zone is surrounded by a rearwardly extending flange of a size and shape to slidably seat in said vent opening.

12. A grill for a boat as described in claim 11 wherein said primary section has a rearwardly extending rim along its lateral edge for engaging the panel, the primary section recess located between said rim and said flange; each of said end sections having a rearwardly extending rim along both lateral edges thereof and an end thereof opposite from said fingers, the respective said recess on each of said end sections being located inside the rim; said fingers being formed within the said recesses of both said primary and end sections.

13. A grill for a vent opening in a panel of a boat, said grill having a primary section and a pair of end sections, said primary section having a ventilation zone, said zone having a plurality of air flow openings extending therethrough separated by narrow elongated vanes; said zone being spaced from both sides and the ends of said primary section and surrounded by a rearwardly projecting flange; each of said end sections and end portions of said primary section having a back face with a recess therein, said primary and end sections having abutting edges and interengaging fingers in their respective recesses, said fingers projecting from their respective abutment edges with the fingers on said primary section extending into the recess of the corresponding one of said end sections whereby said end sections hold said primary section against the surface of said panel.

14. A grill as described in claim 13 where said primary and end sections are each molded as one piece components from a synthetic resin resistant to ultraviolet light.

* * * * *